US008069924B2

(12) United States Patent
Khomynets

(10) Patent No.: US 8,069,924 B2
(45) Date of Patent: Dec. 6, 2011

(54) WELL JET DEVICE AND THE OPERATING METHOD THEREOF

(76) Inventor: Zinoviy Dmitrievich Khomynets, Moscow (RU)

( * ) Notice: Subject to any disclaimer, the term of this patent is extended or adjusted under 35 U.S.C. 154(b) by 784 days.

(21) Appl. No.: 12/067,445

(22) PCT Filed: Jul. 17, 2006

(86) PCT No.: PCT/RU2006/000313

§ 371 (c)(1),
(2), (4) Date: Aug. 13, 2008

(87) PCT Pub. No.: WO2007/035128

PCT Pub. Date: Mar. 29, 2007

(65) Prior Publication Data

US 2009/0016900 A1 Jan. 15, 2009

(30) Foreign Application Priority Data

Sep. 20, 2005 (RU) ..... 2005128972

(51) Int. Cl.
*E21B 43/12* (2006.01)

(52) U.S. Cl. ..... 166/372; 417/172

(58) Field of Classification Search ..... 166/321, 166/369, 372, 374; 417/172
See application file for complete search history.

(56) References Cited

U.S. PATENT DOCUMENTS

| | | | | |
|---|---|---|---|---|
| 4,744,730 | A | 5/1988 | Roeder | |
| 7,743,854 | B2 * | 6/2010 | Khomynets | 175/372 |
| 2004/0071557 | A1 | 4/2004 | Khomynets | |

FOREIGN PATENT DOCUMENTS

| | | | |
|---|---|---|---|
| RU | 2059891 | C1 | 5/1996 |
| RU | 2129672 | C1 | 4/1999 |

* cited by examiner

*Primary Examiner* — William P Neuder
(74) *Attorney, Agent, or Firm* — patenttm.us

(57) ABSTRACT

A well jet device for testing oil-gas wells comprises a body provided with bypass windows and an insert provided with a jet pump. The insert has channels and a mounting seat embodied therein, carrying a sealing unit with a channel for a cable and well instruments fixed thereto. An output channel communicates with an upstream cavity. A supporting sleeve, provided with bypass openings embodied in the wall of the sleeve and with a flange arranged in the lower part thereof, axially movable and spring-loaded with respect to the body, is arranged therein. A recess used for limiting the displacement of the sleeve flange and connected to the bypass windows is formed thereunder. In the lower position of the sleeve, channel for supplying active medium is linked with surrounding space through the bypass openings and windows, whereas in the top position thereof the windows are closed by the sleeve wall.

4 Claims, 2 Drawing Sheets

WELL JET DEVICE AND THE OPERATING METHOD THEREOF

FIELD OF THE INVENTION

This invention relates to pump equipment, in particular to well pumping units for testing oil and gas wells.

PRIOR ART

A well jet device is known that comprises a jet pump installed on the production string in the well and a geophysical instrument arranged in the production string below the jet pump (RU 2059891 C1).

The same patent teaches a method of operating a well jet device, comprising feeding an active fluid through a pipe string to the nozzle of a jet pump, wherein said active fluid, while exiting the pump entraps a pumped liquid fluid to a mixing chamber, from the latter a fluid mixture is supplied to a diffuser where kinematic energy of the flow is partially transformed to its potential energy, and from the diffuser said fluid mixture is supplied along the annular space of the pipe string to a consumer, the physical parameters of the pumped out fluid and the producing formation (pressure, density, gas saturation, solid phase content, temperature, flow speed, flow rate, etc.) at the pump inlet being measured with the use of an instrument comprising physical field radiators and detectors-transducers and transmitted via a cable to the surface, necessary measurements being carried out by changing flow rates and pressures of the active fluid for selecting the optimal mode of operating the jet pump, and in necessary cases the pumped out fluid and the producing formation are treated (by heating, ultrasonic disintegration of a mud grout, etc.) with the use of physical field radiators.

The known device and the method of operating it enable to pump various produced fluids, e.g., oil, out of a well, while simultaneously treating and examining of a produced fluid and the near-well area of a formation.

However, this device provides that a working fluid is supplied to the nozzle of the jet device along the pipe string, which, in a number of cases, narrows its field of application.

A well jet device is the closest to this invention as to its technical essence and effect, which comprises: a body provided with bypass windows and an insert provided with a jet pump, said insert being provided with a through channel; a channel for supplying an active fluid to the nozzle of the jet pump; a channel for supplying a pumped out fluid to the jet pump, which channel is connected to the said through channel; and an output channel, wherein above the channel for supplying a pumped out fluid a mounting seat is made in the through channel; a sealing assembly is installed onto the mounting seat and has an axial channel capable of passing, through it and through the channel for supplying a pumped out fluid, a cable or wire for arranging on it in a well and below the jet pump well instruments and equipment which may be moved along the borehole when the jet pump is or is not operated; the output channel is connected to the inner cavity of the body above the jet pump; and sealing elements are installed on the insert (US 2004/0071557 A1).

The same source teaches a method of operating a well jet device, which includes the stages of: lowering a pipe string with a packer and the body into a well and arranging the packer above a producing formation; making the packer operative thus separating the well space surrounding the pipe string; lowering an insert with a jet pump and a sealing unit as well as instruments and equipment arranged on a cable below the insert into the pipe string; locking the insert with the jet pump in the body by a locking mechanism; pumping an active fluid into the annular space surrounding the pipe string, wherein the active fluid at the nozzle outlet transforms into a stable flow entrapping the surrounding fluid into the jet pump, which leads to a pressure reduction first in the channel for supplying a pumped out fluid and then in the well area below the packer, thus creating pressure drawdown to the producing formation, fluid mixture exiting, due to the working fluid energy, along the pipe string to the surface; and, while pumping out the formation fluid, monitoring the parameters of the pumped out fluid and acting with physical fields on the producing formation with instruments and equipment arranged on the cable.

The known well jet device and the method of operating it enable to conduct various process operations in a well at a level below the installed jet pump, including cases of reducing differential pressures above and below the sealing unit.

But this well jet device does not enable using its capabilities in full, which is connected with its design limitations becoming obvious when studying producing formations in a well or when pumping acid solutions and hydrofracturing liquids into a formation.

SUMMARY OF THE INVENTION

The objective of this invention is to expand process capabilities of a well jet device when using it for carrying out various studies and other works in a well.

The technical effect of this invention makes possible to reduce time spent for carrying out studies, repairing and developing wells, as well as to increase reliability of information that may be obtained on physical properties of producing formations.

This objective is achieved in respect of a device owing to the fact that a well jet device comprises a body provided with bypass windows, and an insert provided with a jet pump, wherein the said insert is provided with a through channel, a channel for supplying an active fluid to the nozzle of the jet pump, a channel for supplying a pumped out fluid to the jet pump, the latter channel being connected to the through channel, and an output channel, and wherein a mounting seat is made in the through channel and above the channel for supplying a pumped out fluid, the mounting seat carrying a sealing unit, and the latter is provided with an axial channel for passing through it and through the channel for supplying a pumped out fluid a cable or wire for the purpose of arranging on it borehole instruments and equipment capable of being moved along the borehole when the jet pump is or is not operated. An output channel is connected to the body inner cavity upstream the jet pump, and sealing elements are arranged on the insert. A supporting sleeve, which is axially movable, is arranged in the body and spring-loaded against it, and the insert with the jet pump is arranged on a mounting seat made in the supporting sleeve, the said supporting sleeve being provided with bypass openings made in its wall and with a flange made in its lower portion. A circular recess is made in the body under the bypass windows, wherein the said recess limits by its ends movement of the supporting sleeve flange arranged in it and communicates, through a gap between the supporting sleeve and the body, to the bypass windows made in the body. When the supporting sleeve is in its lower position the channel for supplying an active fluid is connected with the space surrounding the body through the bypass openings and the bypass windows, and when the supporting sleeve is in its upper position the bypass windows made in the body are closed by the supporting sleeve wall.

This objective is also achieved in respect of a device owing to the fact that additional sealing elements may be arranged on the supporting sleeve upstream the bypass openings and on the flange.

This objective is achieved in respect of a device owing to the fact that the bypass windows in the body may be provided with a filter made in the form of a shell.

This objective is achieved in respect of a method owing to the fact that a method of operating the inventive well jet pump consists in lowering the body provided with bypass windows and a supporting spring-loaded sleeve having bypass openings into a well on a pipe string, wherein the bypass windows of the body are closed by the supporting sleeve that is in its upper position due to the spring action, lowering an insert with the jet pump arranged on a cable or wire into the well, the said cable or wire being passed via an axial channel made in a sealing unit as well as via a through channel and a channel for supplying a pumped out fluid in the insert. The sealing unit is arranged on a mounting seat made in the through channel. Borehole instruments and equipment, e.g., a well-logging instrument, are connected to the lower end of the cable or wire. Then an insert provided with a jet pump and a sealing unit is installed on the mounting seat made in the supporting sleeve, and borehole instruments and equipment are arranged with the use of the said cable or wire at a predetermined depth in the well below the body. Further, an active fluid, e.g., a salt solution or oil is supplied via the annular space surrounding the pipe string and the body into a gap between the body and the supporting sleeve, thus moving the spring-loaded supporting sleeve firmly downward for aligning the bypass openings made in the sleeve with the bypass windows made in the body. An active fluid is supplied through the bypass openings to the channel for supplying the active fluid and further to the nozzle of the jet pump for the purpose of forming a stable flow at the nozzle outlet, wherein such a flow exiting the nozzle causes a pressure reduction first in the channel for supplying a pumped out fluid and then in the inner cavity of the pipe string below the body of the jet pump, thus creating a pressure drawdown on a producing formation in the well and entrapping a pumped out fluid into the jet pump during pumping out a formation fluid. The parameters of a pumped out formation fluid and the physical parameters of the producing formation are monitored along the borehole with borehole instruments and equipment that are arranged on the cable or wire. Formations are perforated in the pressure drawdown mode, the producing formation is selectively acted on by acoustical methods, and down-hole samples are taken at bottom-hole pressures regulated with the use of the jet pump. Then, supply of the active fluid is stopped, thus moving, under spring action, the supporting sleeve together with the insert to its upper position, and the inner cavity of the pipe string is isolated from the annular space. The insert with the jet pump, bore instruments and equipment is raised to the surface, and an acid solution or a hydrofracturing liquid is pumped through the pipe string into the area under the packer; or flexible pipes may be passed through the pipe string and the body for the purposes of cleaning the bottom-hole space from a propant, sand, sludge and other contaminants and pumping cementing materials for carrying out water-isolation works or making cement bridgings.

An analysis of the inventive well jet device operation shows that the intensity of work on studying a well may be raised by expanding the range of works and studies that may be conducted in a well without raising the well jet device to the surface. Making the body of the inventive well jet device with a supporting sleeve that is spring-loaded against the body enables, while carrying out certain process operations, to close the bypass windows and, thus, separate the inner cavity and the surrounding space of the body. If and when necessary, the insert with the jet pump may be removed from the supporting sleeve, and for the purpose of washing the bottom-hole or installing a cement bridging a flexible pipe may be passed into a well through the supporting sleeve in the well jet device body without raising a pipe string, which is used, as a rule, for arranging the well jet device body thereon. Moreover, an acid solution and/or a hydrofracturing liquid may be pumped into a formation through a pipe string and a supporting sleeve. Then, the insert with the jet pump may be returned to the mounting seat in the supporting sleeve, and works on studying, testing or repairing wells as well as for removing reaction products or the hydrofracturing liquid may be continued. Thus, a possibility will be ensured, while operating the inventive well jet device, for studying a well in different operation modes both before and after such treatment.

Thus, the objective of this invention is fulfilled, that is, technological capabilities of a well jet device are expanded for carrying out various formation studies and other works in wells with the use of the inventive device.

DESCRIPTION OF A PREFERRED EMBODIMENT

Figure 1:
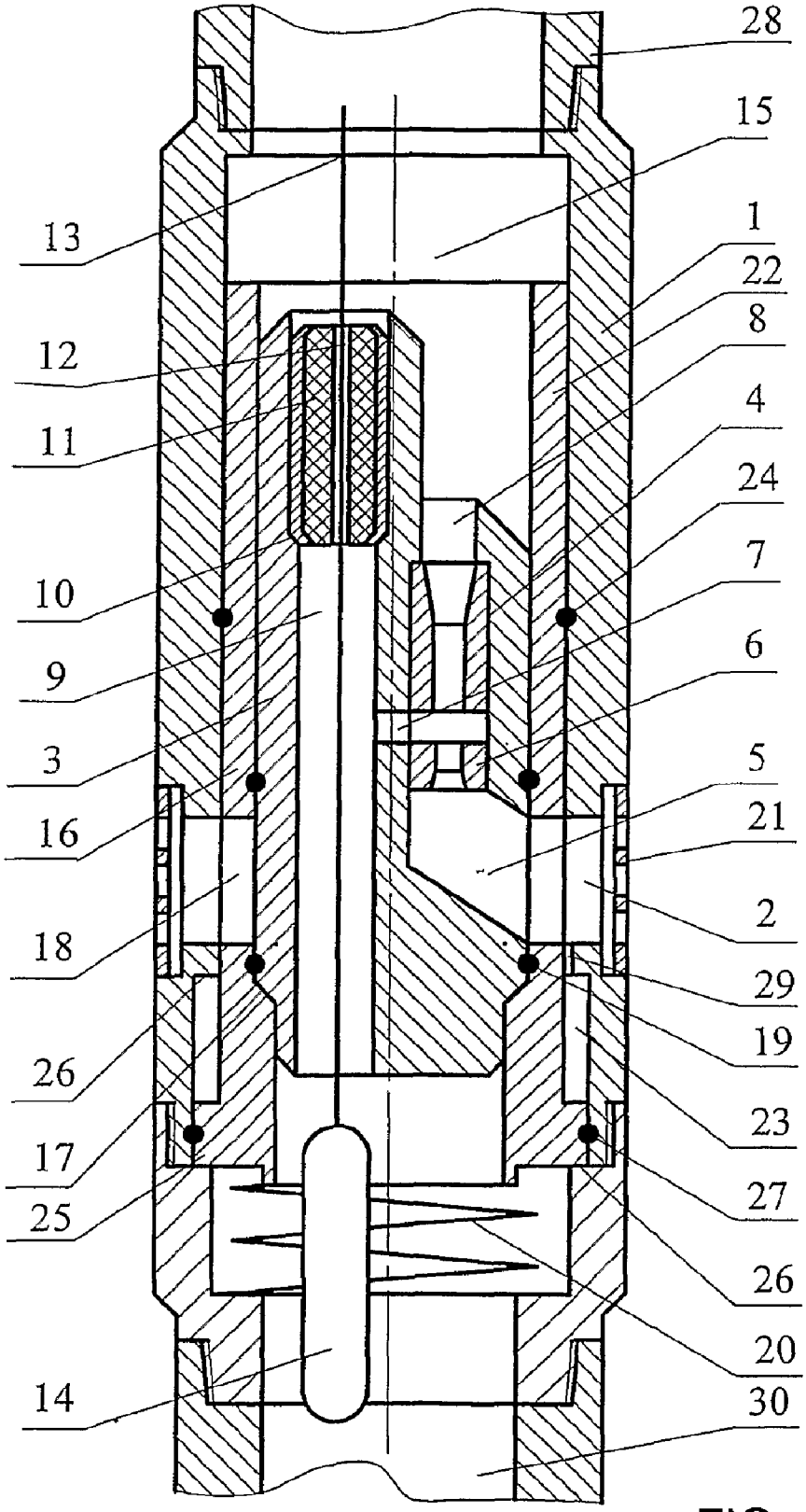
FIG. 1 shows the inventive well jet device.
Figure 2:
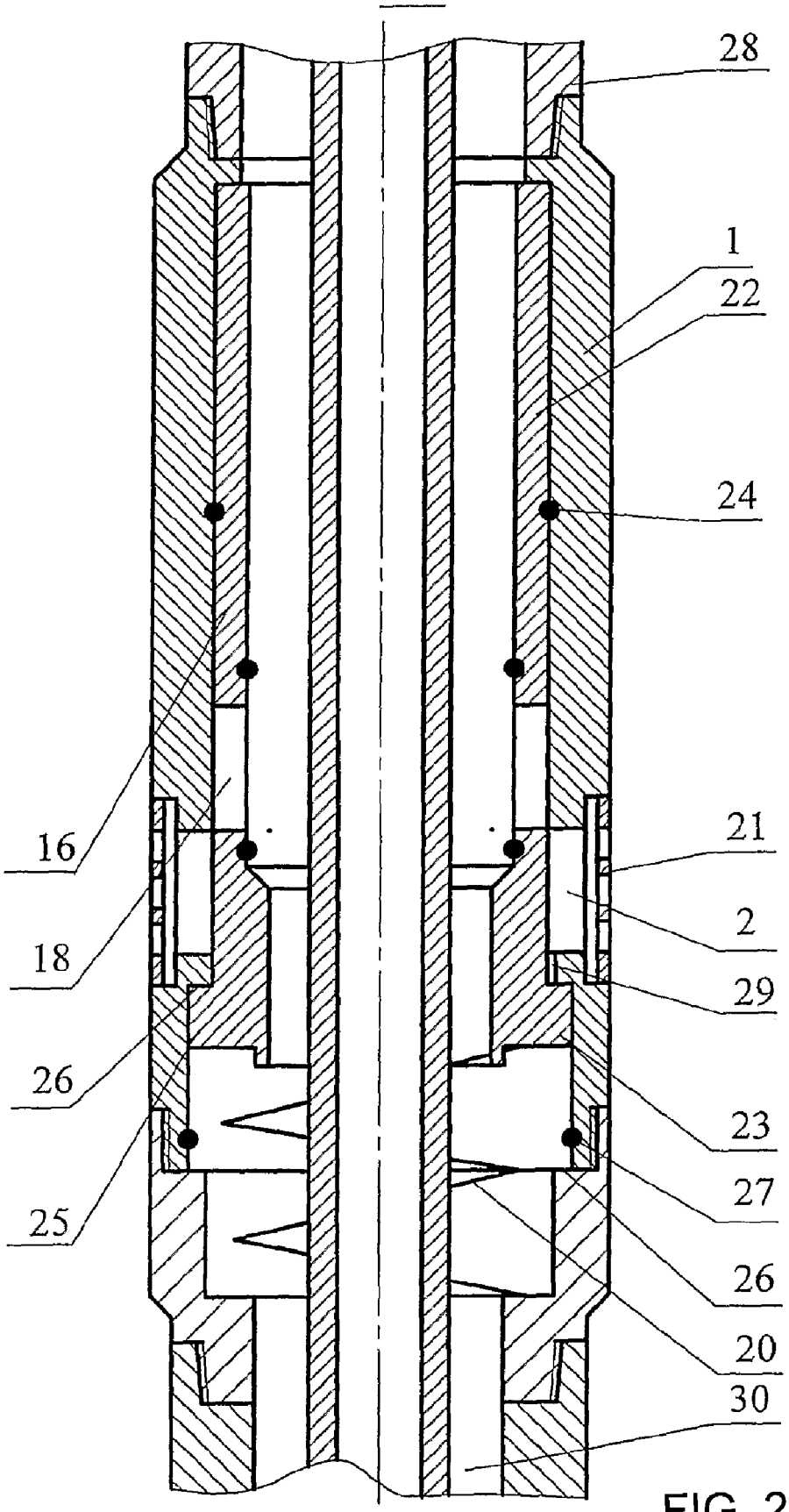
FIG. 2 shows the inventive well jet device with the insert removed and a flexible pipe passed through a pipe string and the device body.

The claimed well jet device comprises a body 1 provided with bypass windows 2 and an insert 3 provided with a jet pump 4 and a through channel 9. Further, the insert 3 is provided with a channel 5 for supplying an active fluid to the nozzle 6 of the jet pump 4, a channel 7 for supplying a pumped out fluid to the jet pump, said channel 7 being connected to the through channel 9, and an output channel 8. A mounting seat 10 is made above the channel 7 for supplying a pumped out fluid in the through channel 9 for the purpose of arranging a sealing unit 11 in the through channel 9. The sealing unit 11 is provided with an axial channel 12 for passing through it and the through channel 9 a cable or wire 13 for the purpose of arranging borehole instruments and equipment 14 on it and below the jet pump 4 in a well with the possibility of moving them along the well borehole when the jet pump 4 is or is not operated. The output channel 8 communicates with the inner cavity 15 of the body 1 upstream the jet pump 4. The insert 3 is provided with sealing elements 19, e.g., O-rings made of an elastic material or sealing rings made of a fluorocarbon polymer. The body 1 is provided with a supporting sleeve 16 that is axially movable and spring-loaded against the body 1 by a spring 20. The insert 3 with the jet pump 4 is installed on the mounting seat 17 made in the supporting sleeve 16. The sealing elements 19 on the insert 3 have the same diameter and are arranged above and below the channel 5 for supplying an active fluid to the nozzle 6 of the jet pump 4. The sleeve 16 is provided with bypass openings 18, through which and through the bypass windows 2 of the body 1 the channel 5 for supplying an active fluid communicates, when the supporting sleeve 16 is in its lowermost position, with the space surrounding the body 1. The lower part 25 of the supporting sleeve 16 under the bypass openings 18 has a greater diameter than that of its upper part 22 and is made as a flange. The upper part 22 of the supporting sleeve 16 and the lower part 25 (at the flange) of the supporting sleeve 16 are provided with additional sealing elements 24 and 27, respectively, which are arranged under the bypass openings 18, have lesser and greater diameter, respectively, and close the gap 29 between the inner surface of the body 1 and the outer surface of the sleeve 16. An annular bore 23 is made in the body 1 under the bypass windows 2, in which the lower part 25, made as a flange, of the supporting sleeve 16 is arranged. The annular bore is made so as to form the upper and the lower ends 26 in the body 1. Downward displacement of the supporting sleeve 16 is limited by the lower end 26 and its upward movement is limited by the upper end 26. The bypass windows 2 of the body 1 are closed by a filter 21 made in the form of a shell.

The claimed method of operating the above well jet device is as follows.

The body 1 is lowered into a well on a pipe string 28. The bypass windows 2 of the body 1 are closed by the supporting sleeve 16, which is in its upper position due to the action of a spring 20. The insert 3 together with the jet pump 4 is lowered on a cable or wire 13 into the well, the said cable or wire being passed via an axial channel 12 made in the sealing unit 11 and via the through channel 9 of the insert 3. The sealing unit 11 is on the mounting seat 10 in the through channel 9, and a borehole instrument 14 or other borehole equipment, e.g., an ultrasonic radiator or pressure and temperature sensors, is connected to the lower end of the cable or wire 13. The insert 3 together with the jet pump 4 and the sealing unit 11 is installed on the mounting seat 17 of the supporting sleeve 16, and a borehole instrument 14 or other equipment is lowered with the use of the cable or wire 13 to a required depth under the body 1. An active fluid, e.g., water, a salt solution, oil, etc., is pumped into the annular space surrounding the pipe string 28 and the body 1. The active fluid comes to the bypass windows 2 through the filter 21 and further into the annular bore 23 through the gap 29 between the body 1 and the supporting sleeve 16, remaining between sealing rings 24 and 27. Under pressure of the active fluid, which is exerted on the lower part 25 of the supporting sleeve 16, the latter moves down up to the lower end 26 within the body 1, the bypass openings 18 of the sleeve 16 being aligned with the bypass windows of the body 1 and the active fluid coming through the bypass windows 2, the bypass openings 18 and the channel 5 for supplying the active fluid to the nozzle 6 of the jet pump 4. Due to pumping the active fluid through the nozzle 6 a stable flow is formed at its exit, which, while exiting the nozzle 6, entraps a fluid pumped out of the well into the jet pump 4, which results in pressure reduction first in the channel 7 for supplying a pumped out fluid and then in the through channel 9 downstream the sealing unit 11 and in the inner cavity 30 of the pipe string 28 below the body 1 of the jet pump 4, thus creating pressure drawdown to a producing formation in the well. The amount of bottom-hole pressure reduction depends on a rate of an active fluid coming through the nozzle 6, which, in its turn, depends on the pressure of an active fluid delivered to the annular space of a well. As a result, a formation fluid comes to the jet pump 4 via the through channel 9 and the channel 7 for supplying a pumped out fluid, where is it mixed with the active fluid, and a fluid mixture is supplied by the active fluid energy along the pipe string from the well to the surface. During pumping out a formation fluid the parameters of the pumped out formation fluid and the physical parameters of the producing formation are monitored along the borehole with borehole instruments and equipment 14 that are arranged on the cable or wire 13, and the producing formation is perforated in the pressure drawdown mode, the producing formation is selectively acted on by acoustical methods, and down-hole samples are taken at bottom-hole pressures regulated with the use of the jet pump. After finishing supplying the active fluid to the nozzle 6 of the jet pump 4 the supporting sleeve 16 moves to its upper position under the action of the spring 20, closing the bypass windows 2 and, thus, isolating the inner cavity 30 of the pipe string 28. Then the insert 3 together with the jet pump 4, borehole instruments and equipment is raised from the body 1 to the surface. The pipe string 28 may be used for pumping an acid solution or a hydrofracturing liquid into the area under the packer or for passing flexible pipes for the purpose of cleaning the well bottom from a propant, sand, sludge and other contaminants, as well as for pumping cementing materials for carrying out water-isolation works or installing cement bridgings.

INDUSTRIAL APPLICABILITY

This invention may be applicable in the oil and gas industry for testing, developing and operating oil and gas-condensate wells as well as for carrying out their workover.

What is claimed, is:

1. A well jet device comprising a body provided with bypass windows and an insert provided with a jet pump, said insert being provided with a through channel and a channel for supplying an active fluid to a nozzle of the jet pump, a channel for supplying a pumped out fluid to the jet pump, said channel being connected to the through channel, and an output channel, and a mounting seat is made in the through channel above the channel for supplying a pumped out fluid for the purpose of arranging a sealing unit in the through channel, said sealing unit is provided with an axial channel for passing via the sealing unit and via the through channel a cable or wire for the purpose of arranging borehole instruments and equipment on the cable or wire and below the jet pump in a well with the possibility of moving them along the well borehole when the jet pump is or is not operated, said output channel communicates with the inner cavity of the body upstream the jet pump, and the insert is provided with sealing elements, characterized in that the body is provided with a supporting sleeve that is axially movable and spring-loaded against the body, and the insert with the jet pump is installed on a mounting seat made in the supporting sleeve, said supporting sleeve being provided with bypass openings in a wall of the supporting sleeve and a flange in a lower part of the supporting sleeve, an annular recess is made in the body under the bypass windows, said recess limiting by its ends movements of the supporting sleeve flange arranged therein and communicating with the body bypass windows through a gap between the supporting sleeve and the body with the bypass windows, in the lower position of the supporting sleeve said channel for supplying an active fluid being connected to a space surrounding the body through the bypass openings and the bypass windows and in its upper position the body bypass windows being closed by the supporting sleeve wall.

2. A well jet device according to claim 1, characterized in that additional sealing elements are installed on the supporting sleeve above the bypass openings and on the flange.

3. A well jet device comprising a body provided with bypass windows and an insert provided with a jet pump, said insert being provided with a through channel and a channel for supplying an active fluid to a nozzle of the jet pump, a channel for supplying a pumped out fluid to the jet pump, said channel being connected to the through channel, and an output channel, and a mounting seat is made in the through channel above the channel for supplying a pumped out fluid for the purpose of arranging a sealing unit in the through channel, said sealing unit is provided with an axial channel for passing via the sealing unit and via the through channel a cable or wire for the purpose of arranging borehole instruments and equipment on the cable or wire and below the jet pump in a well with the possibility of moving them along the well borehole when the jet pump is or is not operated, said output channel communicates with the inner cavity of the body upstream the jet pump, and the insert is provided with sealing elements, characterized in that the body is provided with a supporting sleeve that is axially movable and spring-loaded against the body, and the insert with the jet pump is installed on a mounting seat made in the supporting sleeve, said supporting sleeve being provided with bypass openings in a wall of the supporting sleeve and a flange in a lower part of the supporting sleeve, an annular recess is made in the body under the bypass windows, said recess limiting by its ends movements of the supporting sleeve flange arranged therein and communicating with the body bypass windows through a gap between the supporting sleeve and the body with the bypass windows, in the lower position of the supporting sleeve said channel for supplying an active fluid being connected to a space surrounding the body through the bypass openings and the bypass windows and in its upper position the body bypass windows being closed by the supporting sleeve wall, characterized in that the body bypass windows are provided with a filter made in the form of a shell.

4. A method of operating a well jet device consisting in that:

a body provided with bypass windows and a spring-loaded supporting sleeve having bypass openings is lowered into a well on a pipe string, said body bypass windows being closed by the supporting sleeve, the supporting sleeve being in an upper position due to action of a spring, an insert together with a jet pump is lowered on a cable or wire into a well, the said cable or wire being already passed via an axial channel made in a sealing unit and via a through channel and a channel for supplying a pumped out fluid, both channels being made in said insert, the sealing unit being installed on a mounting seat made in the through channel, and borehole instruments and equipment, e.g., a well-logging device, being connected to the lower end of the cable or wire, then the insert with the jet pump and the sealing unit is installed on a mounting seat made in the supporting sleeve, and borehole instruments and equipment are arranged with the use of the cable or wire at a predetermined depth below the body in the well, after which an active fluid, e.g., water, a salt solution or oil, is supplied through the well annular space surrounding the pipe string and the body into a gap between the body and the supporting sleeve, thus moving the spring-loaded supporting sleeve firmly downward and aligning the sleeve bypass openings with the body bypass windows, and the active fluid is supplied into the channel for supplying an active fluid and further to the jet pump nozzle, forming a stable flow at the nozzle exit, which, while exiting the nozzle, causes pressure reduction first in the channel for supplying a pumped out fluid and then in the inner cavity of the pipe string below the jet pump body, thus creating pressure drawdown on a producing formation and entrapping a formation fluid, which is pumped out of the well, into the jet pump, during pumping out a formation fluid the parameters of the pumped out formation fluid and the physical parameters of the producing formation are monitored along the borehole with borehole instruments and equipment that are arranged on the cable or wire, and the producing formation is perforated in the pressure drawdown mode, the producing formation is selectively acted on by acoustical methods, and down-hole samples are taken at bottom-hole pressures regulated with the use of the jet pump, then the supply of the active fluid is finished, thus moving the supporting sleeve with the insert into its upper position under the action of the spring, and the inner cavity of the pipe string is isolated from the annular space, after which the insert with the jet pump, borehole instruments and equipment is removed to the surface with the use of the cable or wire, and then an acid solution, or a hydrofracturing liquid is pumped into the under-packer area, or flexible pipes are passed through the pipe string and the body for cleaning the well bottom from a propant, sand, sludge and other contaminants as well as for pumping cementing materials into the well for the purpose of carrying out water-isolation works or installing cement bridgings.

* * * * *